United States Patent [19]

Connolly et al.

[11] 4,286,638

[45] Sep. 1, 1981

[54] APPARATUS FOR MEASURING, CUTTING AND SPLITTING LOGS

[76] Inventors: Bruce Connolly; J. Bruce Bradicich, both of c/o Forest-All Corporation, Sheep Davis Rd., Concord, N.H. 03301

[21] Appl. No.: 121,058

[22] Filed: Feb. 13, 1980

[51] Int. Cl.[3] ..... B27L 7/00

[52] U.S. Cl. ..... 144/3 K; 144/193 A; 144/326 R; 198/486; 414/745

[58] Field of Search ..... 198/484, 485, 486; 414/745, 748, 736; 83/733, 425.1; 144/3 K, 193 R, 193 A, 326 R, 323

[56] References Cited

U.S. PATENT DOCUMENTS

| | | | |
|---|---|---|---|
| 2,711,817 | 6/1955 | Hautau et al. | 198/486 |
| 4,173,237 | 11/1979 | Heikkinen et al. | 144/3 K |

FOREIGN PATENT DOCUMENTS

| | | | |
|---|---|---|---|
| 127503 | 5/1948 | Australia | 144/193 R |
| 1028933 | 4/1978 | Canada | 144/3 K |
| 144977 | 4/1960 | U.S.S.R. | 144/3 K |
| 599971 | 4/1978 | U.S.S.R. | 144/193 A |

*Primary Examiner*—W. D. Bray
*Attorney, Agent, or Firm*—C. Yardley Chittick

[57] ABSTRACT

A machine for cutting a log into a succession of pieces of predetermined length at a cutting station, moving the cut piece to a first splitting station, splitting said first cut piece at said first splitting station while the next piece is being cut at the cutting station, moving the said next piece to a second splitting station, splitting the said next piece at said second splitting station while a third piece is being cut at the cutting station, moving the said third piece to said first splitting station, and splitting the third piece at said first splitting station while a fourth piece is being cut and so on. The production of split wood is thus substantially increased by the use of two splitters combined with means for moving the successively cut pieces alternately to the splitters.

13 Claims, 6 Drawing Figures

APPARATUS FOR MEASURING, CUTTING AND SPLITTING LOGS

BACKGROUND OF THE INVENTION

Machines for advancing a log step by step, cutting off the end portion to a predetermined length and then splitting the cut portion are well known in the art. See for example U.S. Pat. Nos. 3,862,651 and 4,076,061. All of the prior art devices however are necessarily limited in their output of split logs by the use of a single splitter which is unable to receive and split the logs as rapidly as they can be cut.

BRIEF DESCRIPTION OF THE INVENTION

In the present invention, a principal feature resides in a novel construction which permits the leading end portion of a log to be cut off while the splitting operation on the previously cut piece is taking place.

There are two laterally spaced splitters between which is an oscillating unit having two spaced log carriers. In one position of the unit, the first carrier is aligned with the main log and the second carrier with the first splitter. In the second position of the unit, the first carrier is aligned with the second splitter and the second carrier with the main log.

Thus, while one cut log has been moved by one of the carriers to the first splitter, the other carrier is in position to receive the end of the main log which is being advanced by a conveyor. The advance of the main log is stopped after the end has moved a predetermined distance into the carrier. The end of the log is then cut off by a saw.

By this time the ram of the first splitter has retracted so that the unit may turn to its other position which will place the cut log in the first carrier in alignment with the second splitter and the now empty second carrier will have returned to a position to receive the end of the main log when it is advanced.

After the log has been forced through the second splitter and the ram has been retracted and the next log in the second carrier has been sawed off, the unit turns to its original position, placing the log in the second carrier in alignment with the first splitter and the now empty first carrier is positioned to receive the end of the main log as it is again advanced.

The movements of all of the parts may be manually instituted or they may be synchronized by the use of conventional electric circuitry with the result that a long log can be cut into pieces of firewood length and split into halves, quarters or other fractions much faster than by any of the prior art machines.

In view of the current greatly increased demand for firewood, the present invention furnishes means for increasing production and decreasing the cost of sawing and splitting per cord.

Other aspects of the invention will appear as the description proceeds with the aid of the accompanying drawings in which FIG. 1 is a perspective view of the essential elements of the invention: The supporting frame and motor drives for the main log conveyor, the saw, the oscillating carrier and the firewood conveyor have been omitted.

DESCRIPTION OF A PREFERRED EMBODIMENT

Figure 1:
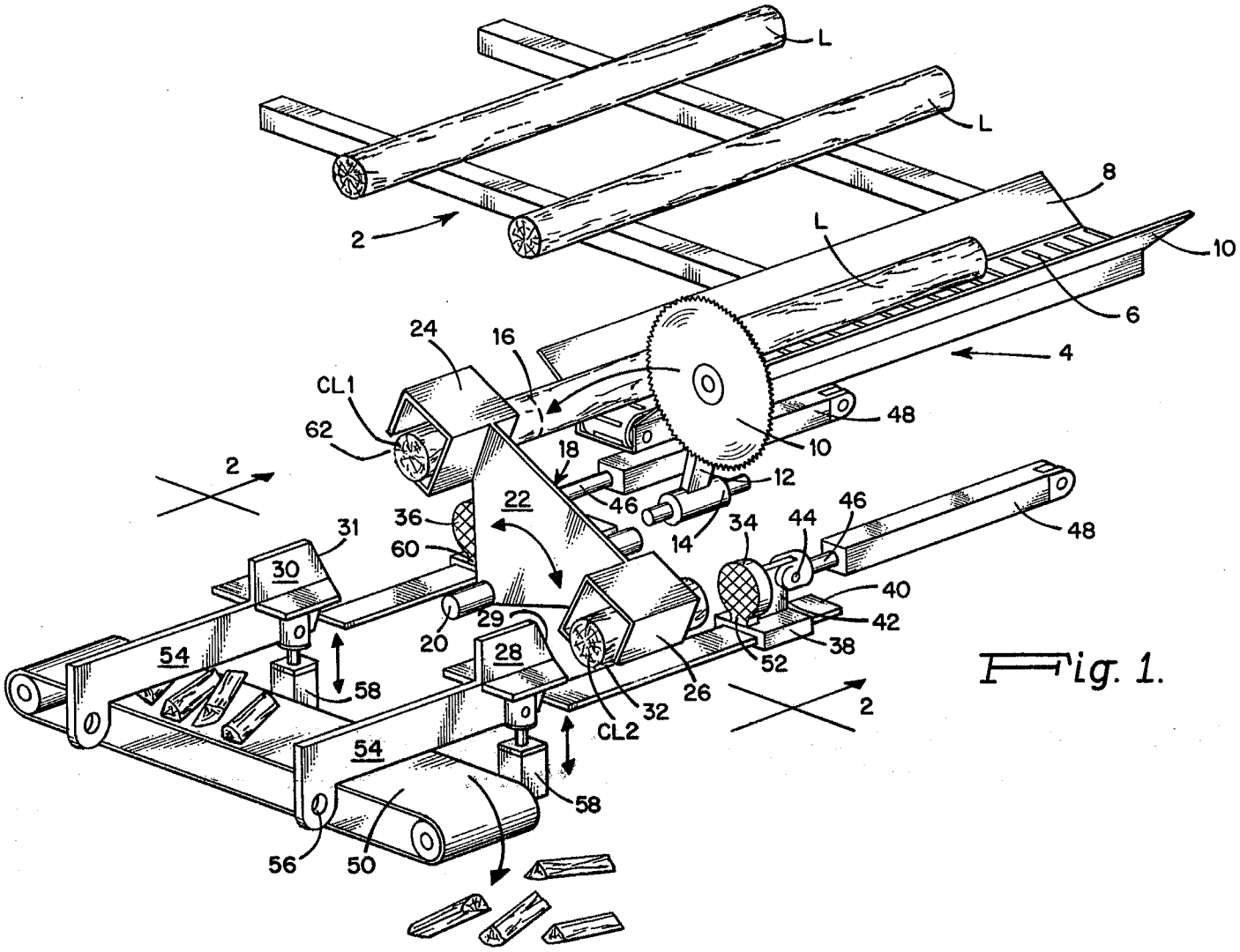

The machine may be understood by reference to FIG. 1. The objective is to cut logs of any length into shorter pieces of selected lengths and finally to split the short lengths into typical firewood. Accordingly the long logs L may be brought to a supply station 2 adjacent the machine generally referred to at 4. The logs are placed seriatim on a conveyor 6 having sloping side guides 8 and 10 which serve to keep the log in proper position.

The conveyor is driven by conventional means capable of advancing the log step by step a distance equal to the selected firewood length. The conveyor drive mechanism may be automatically or manually controlled.

Adjacent the end of the conveyor 6 is a circular saw 10 driven by conventional means (not shown). The saw is mounted on an arm 12 carried by a pivot 14 which permits the saw to be swung in an arc to engage and cut the log at the position 16.

In front of the end of the conveyor is a cut log supporting and positioning unit 18. This unit is mounted for turning movement on a pivot 20. The unit comprises a strong transversely extending supporting frame 22 having mounted at each end a log carrier indicated at 24 and 26.

These carriers are generally square in cross section and open at both ends so that the end of log L may be advanced to extend therethrough. The rectangular dimensions of the carriers are not limited but in a typical construction the carriers will be large enough to receive a log 20" in diameter. The length of the carriers will be sufficient to permit the center of gravity of each of the cut logs indicated in the drawings as CL1 and CL2 to be well within so that the cut logs will be stable as the carriers are moved.

As can be seen in FIG. 1 there are two log splitters indicated at 28 and 30. Each splitter is comprised of fixed wedges 29 and 31 and cooperating rams 34 and 36. When unit 18 is turned to the right as in FIG. 1, the cut log CL2 in carrier 26 will be aligned with splitter 28, and carrier 24 will be aligned with log L. When the unit is rotated to the left, the cut log CL1 in carrier 24 will be aligned with splitter 20 and carrier 26 will be aligned with log L.

From the foregoing it will be understood that a succession of cut logs can be alternately moved from the cutting location to the splitters. Thus while the cutting operation is being performed by saw 10 to leave a cut log in one carrier, the previously cut log in the other carrier will be in the process of being split at one of the splitters.

FIG. 1 illustrates the foregoing statement. While saw 10 is cutting off log CL1 in carrier 24, the previously cut log CL2 is about to be split at splitter 28. As soon as the splitting of log CL2 is completed, unit 18 will rotate to the left to place log CL1 at splitter 30 and the now empty carrier 26 will be positioned to receive the advancing end of log L. Cutting of the next log in carrier 26 occurs while the splitting of log CL1 takes place at splitter 30. This succession of operations may continue as long as logs L are fed to conveyor 6.

Figure 3:
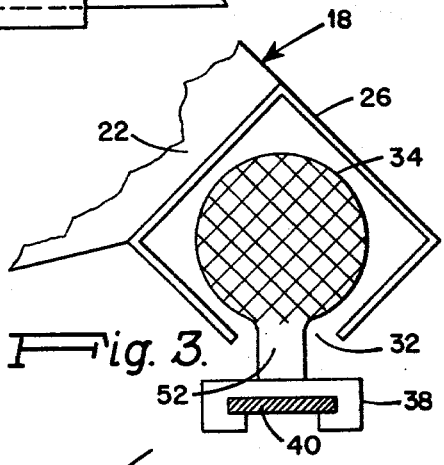
FIG. 3 is an enlarged elevation of the right hand carrier shown in FIG. 2 with the ram therein. It is also a view taken on the line 3—3 of FIG. 4.
Figure 2:
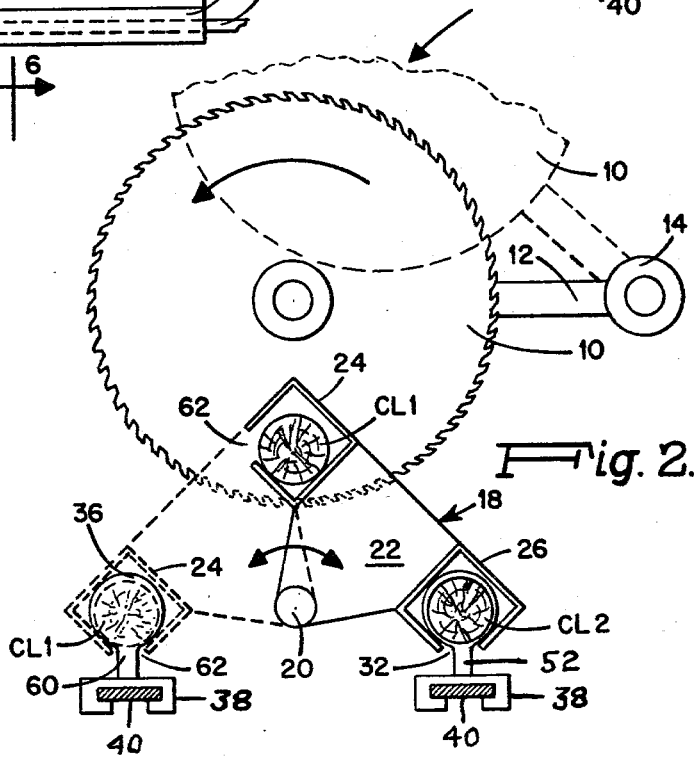
FIG. 2 is an elevational view taken on the line 2—2 of FIG. 1 showing more particularly the two positions of the log carriers and the cutting position of the saw.

The construction of the carriers will now be explained. As can be seen in FIGS. 2 and 3 each carrier has a longitudinal slot extending the full length of the carrier. When a carrier is at the splitting position as is carrier 26 in FIGS. 2 and 3, the slot 32 is at the bottom. At the log receiving position the slot will be at the left side for carrier 24 and at the right side for carrier 26. The slot is necessary to permit the desired cooperation with the ram mechanism that forces the log through the splitter.

The ram construction is best shown in FIG. 1. There are two rams indicated at 34 and 36, ram 34 cooperating with the wedges 29 of splitter 28 and ram 36 cooperating with the wedges 31 of splitter 30. The rams are identical so an explanation of one will suffice for the other. The parts will be identically numbered.

Ram 34 has a face large enough to suitably engage the end of the largest log that will be placed in carrier 26. Ram 34 is mounted on a slide 38 adapted for travel on fixed horizontal support 40. The rear part 42 of ram 34 is pivotally connected at 44 to piston 46 of the hydraulic cylinder 48. Cylinder 48 is secured to the machine frame or otherwise fixed so as to render it immovable longitudinally. Suitable hydraulic piping (not shown) leads to cylinder 48 in conventional manner so that piston 46 may be extended and retracted, all in timed relation to the position of carrier 26.

When carrier 26 with log CL2 therein is in the position shown in FIG. 1, cylinder 48 is actuated to extend piston 46 driving ram 34 against the end of log CL2, forcing the leading end of the log against the splitter 28 to split the log with the pieces falling on conveyor 50 whence they are delivered to a collecting location. While splitters 28 and 30 are shown as having four blades, it will be understood that the number of blades may be more or less as desired.

Slot 32 at the bottom of carrier 26 is wider than ram neck 52 making it possible for the ram to move all the way through carrier 26 without interference to complete the splitting of the log. This is shown in more detail in the enlarged side elevation in FIG. 4 and the front elevation in FIG. 3.

In order that the center of the multiple-bladed splitter may engage the log CL2 at its approximate center (which shifts vertically according to the log diameter) a supporting construction is provided for the splitter wedges whereby the wedges carried by a beam 54 pivoted at 56 can be quickly moved vertically to the aligned position. In the case of a small log which is preferably split in half only, the beam 54 is raised to a position in which the end of the small log engages only the lowermost blade 55. See FIGS. 4 and 5. The free end of beam 54 is supported by a hydraulic jack 58. Thus the operator by conventional remote controls can activate the jack to move the wedges vertically to the required position.

The ram 34 advances far enough to complete the splitting of log CL2. Withdrawal of the ram follows immediately so that the ram will be clear of carrier 26 by the time the sawing off of the next log in carrier 24 has been completed.

At this time, carrier 24 will contain a cut log, carrier 26 will be empty and both rams 34 and 36 will be retracted. Unit 18 is then rotated counterclockwise to place log CL1 in carrier 24 between wedges 31 of splitter 30 and ram 36. Ram 36 is then actuated to split log CL1, the ram passing through carrier 24 and the ram neck 60 moving in slot 62. Simultaneously conveyor 6 moves forward to place the leading end of log L in carrier 26. The advance of log L is stopped at a position to produce a cut log of the required length. As soon as log L has come to a halt, conventional clamps (not shown) engage log L to hold it securely on the conveyor as the saw 10 swings down to cut off the end section of the log at point 16.

By the time saw 10 has completed its cut, ram 36 will have been retracted by its piston 46 so as to be clear of carrier 24. Rotation of unit 18 clockwise then takes place to lower carrier 26 and place the new cut log CL2 between the ram 34 and the splitter wedges 29. Empty carrier 24 will be in raised position ready to receive the leading end of log L as the log is advanced again by conveyor 6.

The previously recited sequence of operations is then continuously repeated.

It should be mentioned that the splitter wedges 31 are mounted in the same manner as wedges 29 on the end of a pivoted beam 54 and supported by a jack 58, permitting quick vertical adjustment of wedges 31.

The beams 54 are far enough above conveyor 50 to permit the split logs to pass thereunder.

The limiting factor in the above described steps is the time required to advance log L to place the end in the empty carrier, stop conveyor 6, clamp the log in place and then saw off the end. During the time required for this operation, the log in the carrier at the splitter will be split and the ram retracted. Thus, as soon as the log has been cut at 16, unit 18 may be instantly rotated to place the new cut log at the other splitter and the empty carrier at log receiving position. This movement of unit 18 takes but a few seconds and the empty carrier is in log receiving position before conveyor 6 can move the log end into the carrier.

It will thus be apparent that split logs can be produced just as fast as log L can be advanced, stopped and sawed. The carriers 24 and 26 serve the further purpose of automatically placing each log in exact aligned position between the ram and wedges so that the resulting split logs are relatively uniform in cross-section. This is desirable from the view point of the purchaser of the firewood.

As has been previously mentioned, it has not been deemed necessary to show the driving means for the various movable parts in that all are conventional mechanisms well known to those familiar with this art. The motors that drive the conveyor 6, that swing saw 10 back and forth and that cause unit 18 to turn to the right and left, may be controlled by manually operated switches or automatically by appropriate electric circuitry. In addition, the valves controlling the operation of cylinders 48 and the related rams 34 and 36 are caused to open and close only when the carriers 24 and 26 have reached positions between the rams and wedges. The jacks are under separate manual control as is conveyor 50.

Figure 4:
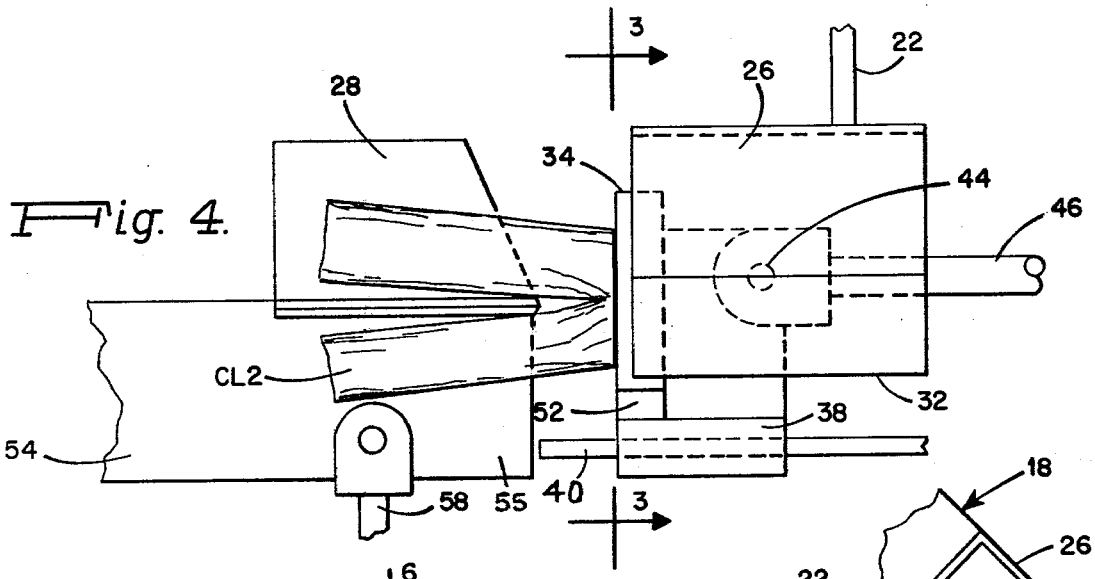
FIG. 4 is a side elevation of FIG. 3 to which has been added the splitter and a log in the process of being split.

While the wedges shown in FIGS. 1 and 4 are constructed to split the logs into four pieces, any other desired arrangement of wedges may be used to divide the log into halves, thirds, fifths or other parts such as one half and two quarters for example.

It should also be mentioned that the cross-sectional configuration of the carriers may be varied. The rectangular form is suitable as the right angled sides supply stable support for the cut log in the upper log receiving position and in the splitting position where the longitudinal slot is below the log.

It is also contemplated that the cutting of log L into successive pieces might be speeded up through the use of other sawing means or the log L might be precut with the precut pieces being fed into the empty carrier at a faster rate. In such case the back and forth turning of unit 18 would have to be correspondingly speeded up. To achieve this result the construction shown in FIGS. 5 and 6 may be used.

Figure 5:
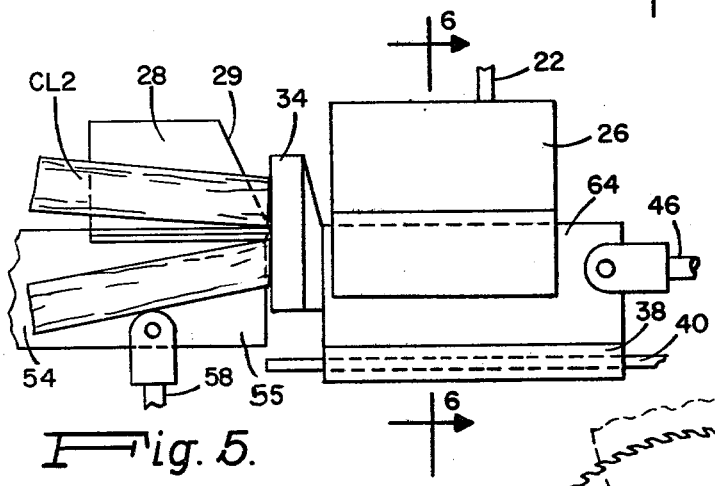
FIG. 5 is a side elevation similar to FIG. 4 showing a modification in which the carrier may be removed before retraction of the ram.
Figure 6:
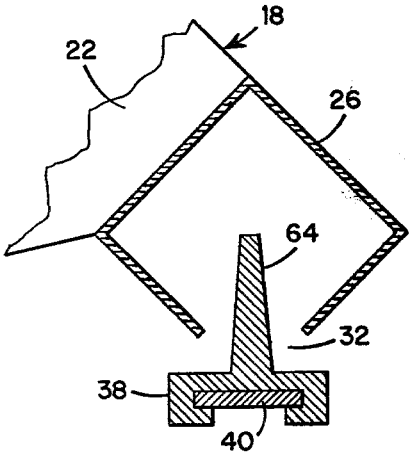
FIG. 6 is a vertical section taken on the line 6—6 of FIG. 5.

In FIGS. 5 and 6, the ram 34 is mounted on the end of a strong web 64 of such height and width that it will not interfere with the arcuate movement of carrier 26. When the ram 34 has advanced far enough to complete the splitting of the log, it will be beyond the end of carrier 26. The ram will be caused to dwell in this position long enough to permit unit 18 to turn to the left, moving carrier 26 upward in an arcuate path without the edges that form the slot 32 engaging web 64.

After carrier 26 is out of the way, piston rod 46 will be retracted by cylinder 48 to move ram 34 to its normal position spaced far enough from wedges 29 to receive the next log brought down by carrier 26.

By utilizing mean such as that shown in FIGS. 5 and 6 or its equivalent, the rate of splitting may be accelerated to match the faster feeding of cut logs to the empty carrier.

The foregoing description of the invention will suggest to others familiar with this art, modifications which will fall within the scope of the appended claims.

We claim:

1. A machine for producing short lengths of split lumber, said machine comprising two laterally spaced log splitters, a transversely movable saw for cutting a periodically axially advancing log into a succession of cut short logs, and means for receiving said cut short logs one at a time and carrying said cut short logs alternately to said splitters.

2. The construction set forth in claim 1, said means for cutting said log into short logs comprising a conveyor for advancing said log periodically in said axial direction and means for actuating said transversely movable saw for cutting off the advanced end of said log when the log end is stationary and positioned in said receiving and carrying means.

3. The construction set forth in claim 2, said means for carrying said cut short logs alternately to said splitters comprising a unit pivoted at a point between said splitters, said unit having two log carriers mounted thereon, said unit being arranged to turn said pivot in a plane transverse to the axis of said log, said carriers being equidistant from said pivot and angularly spaced on said unit so that when one carrier is positioned to receive a cut short log, the other carrier with a cut short log therein will be aligned with one of said splitters.

4. The construction set forth in claim 3, said carriers being tubular and slotted at the bottom when at the splitter position whereby the supporting structure of a ram may move through said slot as said ram forces a log into the wedges of said splitter.

5. A log splitting machine comprising two tublar log carriers mounted on a pivoted frame, two spaced log splitters, each said log splitter comprising stationary wedges and a movable ram, means for rotating said frame back and forth through an angle equal to the angular spacing of said carriers whereby when said frame is stationary at the end of its travel in either direction, one of said carriers will be at a log receiving station and the other carrier will be positioned between the ram and wedges of one of said splitters.

6. The construction set forth in claim 5, said log carriers being longitudinally slotted whereby when a carrier is at a log splitting position, the supporting structure of the related ram may pass therethrough.

7. The construction set forth in claim 5 and means at said log receiving station for placing a cut short log in one of said carriers while the log previously placed in the other of said carriers at said log receiving station, is being split at one of said splitters.

8. The construction set forth in claim 5, the said rams being carried by supporting structure slidably mounted on a fixed member, said carriers being longitudinally slotted whereby when a said ram is actuated, the ram supporting structure may move through said slot, said slot being wider than said supporting structure whereby when said ram has passed through and beyond said carrier, said carrier may be moved upward without interference with said supporting structure.

9. The construction set forth in claim 5, said wedges being supported by remotely controlled means for vertically adjusting the position of said wedges.

10. The construction set forth in claim 9, said adjusting means being in the form of hydraulically operated jacks.

11. A log splitting machine comprising a conveyor for moving a log in an axial direction step by step a predetermined distance, a saw for sawing off the end of said log to produce a short log of said predetermined length, a first tubular carrier for receiving the said short log, means for moving said first carrier in an arcuate path from said log receiving position to a first log splitter, said splitter comprising fixed wedges and a hydraulically operated ram, said ram supported by means movable below and parallel to said carrier axis, said first carrier having a longitudinal slot therein whereby when said first carrier is holding said short log stationary at said first log splitter, said ram may be moved through said first carrier to force said short log into said wedges and said supporting structure will move into said slot, a second tubular carrier mounted in fixed relation to said first carrier and so spaced therefrom that when said first carrier is at the first log splitter position, said second carrier will be at a position to receive the next short log, means for moving said first and second carriers after said first log has been split through arcuate paths to position said second carrier at a second log splitter and said first carrier at its initial log receiving position, said second splitter comprising fixed wedges and a hydraulically operated ram, said ram supported by means movable below and parallel to said second carrier axis, said second carrier having a longitudinal slot therein whereby when said second carrier is holding a short log stationary at said second log splitter, said ram may be moved through said second carrier to force said short log into said wedges and said supporting structure will move into said slot, and means operable after the splitting of said log at said second splitter, to return said second carrier to log receiving position and to move said first carrier with a short log therein to said first log splitter.

12. A machine for producing short lengths of split lumber, said machine comprising, means for advancing a log step by step in an axial direction for a predetermined distance, a transversely movable saw for cutting off a succession of short logs of selected length from the end of said log when said log is stationary, two laterally spaced log splitters, and means for receiving the end of said log prior to cutting and for carrying said successively cut short logs alternately to said splitters.

13. The construction set forth in claim 12, said saw operable only when the end of said log has advanced to a position within said carrying means and said carrying means comprising two spaced log carriers that oscillate back and forth over fixed paths.

* * * * *